US006165032A

United States Patent [19]

Nakamura

[11] Patent Number: 6,165,032

[45] Date of Patent: Dec. 26, 2000

[54] TILT CYLINDER DEVICE FOR OUTBOARD MOTOR

[75] Inventor: Tamotsu Nakamura, Saitama, Japan

[73] Assignee: Showa Corporation, Saitama, Japan

[21] Appl. No.: 09/522,755

[22] Filed: Mar. 10, 2000

[30] Foreign Application Priority Data

Mar. 10, 1999 [JP] Japan ..... 11-064054

[51] Int. Cl.[7] ..... B63H 5/125

[52] U.S. Cl. ..... 440/61; 440/53

[58] Field of Search ..... 440/53, 61, 900

[56] References Cited

U.S. PATENT DOCUMENTS 5,489,226 2/1996 Nakamura et al. ..... 440/61

*Primary Examiner*—Ed Swinehart

*Attorney, Agent, or Firm*—Orum & Roth

[57] ABSTRACT

In a tilt cylinder device for an outboard motor, a piston having its piston rod is extends to an outboard motor side and a free piston are freely movably inserted into a cylinder. Within the cylinder are oil chambers S1, S2, and S3. An accumulator chamber S4 is provided so as to surround the cylinder. A third communication passage is formed from the piston to the free piston. In the third communication passage is provided a second relief valve that opens when the oil chamber S3 has exceeded a set pressure. To this second relief valve is additionally provided an opening/closing mechanism for opening or closing the valve from the outside.

4 Claims, 8 Drawing Sheets

TILT CYLINDER DEVICE FOR OUTBOARD MOTOR

BACKGROUND OF THE INVENTION

1. Field of the Invention

The present invention relates to a tilt cylinder device for an outboard motor that is suitable for being arranged in a compact form.

2. Description of the Related Art

As a tilt lock device for an outboard motor, for example, a "TILT CYLINDER DEVICE FOR USE ON OUTBOARD MOTOR" disclosed in Japanese Patent Application Laid-Open (JP-A) No. 4-5195 is known.

The above device is intended to prevent any damages from being caused to the main body of an outboard motor where an excessively large force has acted thereon during forward travel or reverse travel. As illustrated in FIGS. 1 and 3 of the above publication, the disclosure involves a tilt cylinder device 10 between a hull and the main body 7 of the outboard motor. This tilt cylinder device 10 is equipped with a cylinder 11, a piston 13 which is vertically movably and which is inserted into the cylinder 11, and a free piston 14 which is disposed above the piston 13 and is similarly inserted therein to. A piston rod 12 is mounted on a lower portion of the piston 13, a second chamber C2 is formed below the piston 13 within the cylinder 11 and a third chamber C3 is formed above the free piston 14 within the cylinder 11. A communication passage 18 is provided for the purpose of communicating the second C2 and the third chamber C3 and is disposed outside the cylinder 11, and a second pressure relief valve 19 is provided within the communication passage 18.

In the event the main body 7 of the outboard motor has received a large external force during the reverse travel on a shallow that is being made with the main body 7 thereof being somewhat raised, the second pressure relief valve 19 permits the pressure within the third chamber C3 to be relieved into the second chamber C2 via the communication passage 18. The pressure relief valve 19 thereby mitigates the impairment of the main body 7 of the outboard motor.

In the above-described device, the communication passage 18 and the second pressure relief valve 19 are provided outside the cylinder 11. Therefore, there is the disadvantage that there is the need to ensure a large space for the purpose of installing the tilt cylinder device 10 between the hull and the main body 7 of the outboard motor.

SUMMARY OF THE INVENTION

The object of the present invention is to provide a more compact tilt cylinder device for an outboard motor.

The present invention provides a tilt cylinder device for an outboard motor, the tilt cylinder device together with the outboard motor being mounted on a stern enabling the outboard motor to be stopped at a given position when the outboard motor is swung from its use position to a standby position. In order to ease the impact applied to the outboard motor during the travel, the tilt cylinder device is disposed between the stern and the outboard motor, the tilt cylinder device being characterized to include a piston, a piston rod of which is extended to an outboard motor side, and a free piston located below the piston, are movably inserted into a cylinder. An upper oil chamber defined by the piston and the free piston and which is located above the piston, an intermediate oil chamber between the piston and the free piston, and a lower oil chamber located below the See piston are provided within the cylinder. An accumulator chamber is provided for compensating for the volume of an operating oil going into and out of it through the intermediary of only the lower oil chamber in such a way as to follow the in going and the outgoing motion of the piston rod. The accumulator chamber serves concurrently as a volume compensation chamber, and is provided in such a way as to surround the cylinder. A first and a second communication passage communicating the upper oil chamber with the intermediate chamber are provided in the piston. A first relief valve is provided that when the pressure within the upper oil chamber has exceeded a set pressure, the valve is automatically opened to absorb the impact, the valve being disposed in the first communication passage. A one-way valve permitting the flow of the operating oil from the intermediate oil chamber into the upper oil chamber is disposed in the second communication passage. A third communication passage communicating the upper oil chamber and the lower oil chamber is formed in such a way as to cover from the piston to the free piston. A second relief valve is provided such that when the pressure within the lower oil chamber has exceeded a set pressure, the valve is opened and fluid is provided to the third communication passage. In a state of travel on a shallow where the piston and the free piston are moved toward the upper oil chamber and the outboard motor has thereby been swung up to a midway position from the use position to the standby position, when the pressure within the lower oil chamber has exceeded the set pressure, the piston and the free piston are automatically moved toward the lower oil chamber through the opening of the second relief valve and the outboard motor is thereby moved from the shallow travel position to the use position to thereby enable releasing the state of shallow travel. An opening/closing mechanism for opening or closing the second relief valve from the outside is additionally provided to the second relief valve.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings

DESCRIPTION OF THE PREFERRED EMBODIMENTS

An embodiment of the present invention will be explained with reference to the accompanying drawings. The drawings should be seen in view of the reference numbers and symbols.

Figure 1:
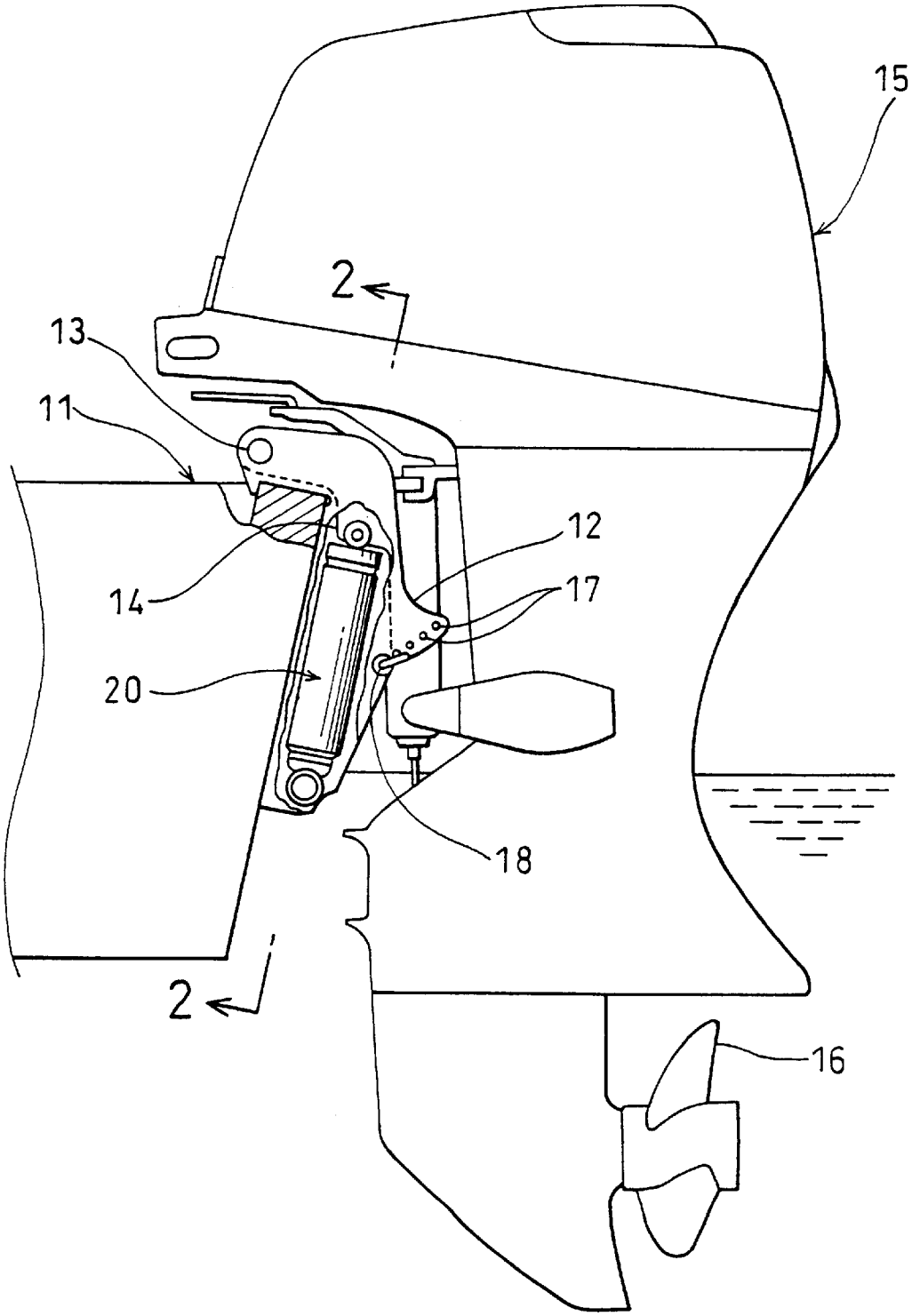
FIG. 1 is a side view illustrating the tilt cylinder device according to the present invention mounted between the stern and the outboard motor.

FIG. 1 is a side view illustrating a state where a tilt cylinder device according to the present invention has been mounted between the stern and the outboard motor. Illustration is made of a state where a stern bracket 12 is fixed to a stern 11. On this stern bracket 12 there is mounted a swivel bracket 14 so that the same may be vertically rotatable about a horizontal axis 13. On this swivel bracket 14 is mounted an outboard motor 15. A tilt cylinder device 20 is disposed between the stern bracket 12 and the swivel bracket 14. Further, reference numeral 16 denotes a propeller of an outboard motor 15, and reference numeral 17 . . . (the ". . . " means the plural, the same is true also hereinafter) denote position-adjusting holes formed at the rear portion of the stern bracket 12. Reference numeral 18 denotes a stopper pin, which is intended to adjust the tilt-down position of the outboard motor 15 by selecting one of the position-adjusting holes 17 . . . and inserting the stopper pin into this selected hole.

Figure 2:
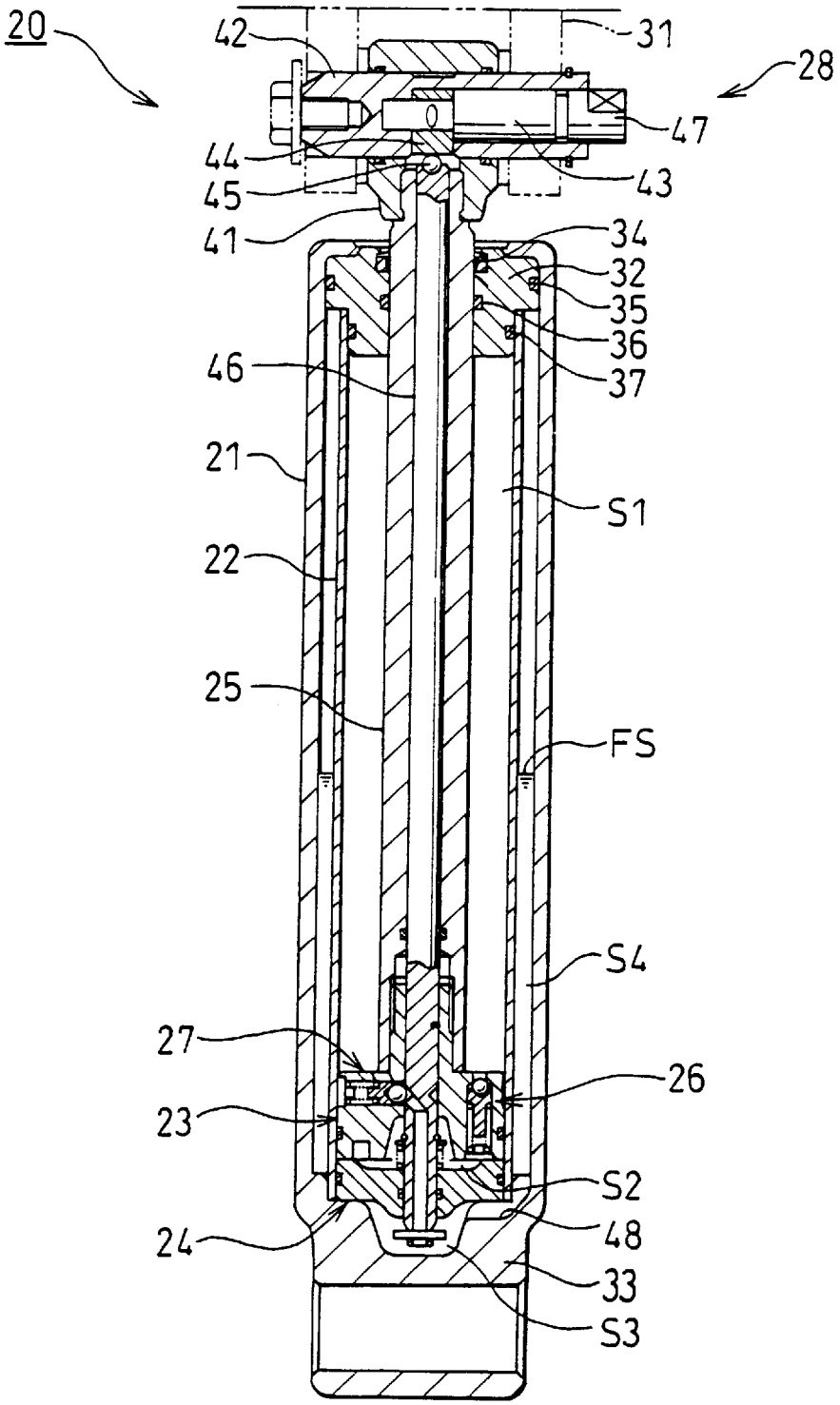
FIG. 2 is a sectional view taken along a line 2—2 of FIG. 1.

FIG. 2 is a view taken along a line 2—2 of FIG. 1. The tilt cylinder device 20 includes an outer cylinder 21, an inner cylinder 22 disposed inside the outer cylinder 21 and serving as a cylinder, a piston 23 and a free piston 24 vertically movably inserted into the inner cylinder 22. A hollow piston rod 25 extends toward above the piston 23, i.e., to an outboard motor 15 (see FIG. 1) side, and serves as a piston rod. First and second relief valves 26, 27 are provided within the piston 23, and an opening/closing mechanism 28 is provided that manually opens and doses the second relief valve 27 from the outside. It is to be noted that reference numeral 31 denotes an upper-portion mounting member for rotatably mounting the upper portion of the piston rod 25 onto the swivel bracket 14 (see FIG. 1).

Also, the tilt cylinder device 20 includes a rod guide 32 that is fixed to an upper portion of the outer cylinder 21 in order to guide the hollow piston rod 25 and retain an upper portion of the inner cylinder 22. A lower-portion mounting portion 33 is integrally provided on a lower portion of the outer cylinder 21 in order to rotatably mount the device 20 to the stem bracket 12 (see FIG. 1). It is to be noted that reference numeral 34 denotes an oil seal; and reference numerals 35, 36, and 37 denote O-rings, respectively.

The tilt cylinder device 20 further includes within the inner cylinder 22 an upper oil chamber S1 defined by the piston 23 and the free piston 24 and located above the piston 23. An intermediate oil chamber S2 is located between the piston 23 and the free piston 24, and a lower oil chamber S3 is located below the free piston 24, and further includes an accumulator chamber S4 provided between the outer cylinder 21 and the inner cylinder 22 which serves as a volume compensation chamber.

The opening/closing mechanism 28 includes a joint portion 41 mounted on an upper end of the hollow piston rod 25, a joint shaft 42 mounted on the joint portion 41, a cam shaft 43 rotatably mounted on the joint portion 41, a cam portion 44 mounted on the cam shaft 43, a ball 45 disposed in abutment with the peripheral surface of the cam portion 44, and an operation rod 46 vertically moved within each of the piston 23, free piston 24, and hollow piston rod 25 in such a way as to follow the cam portion 44 via the ball 45. It is to be noted that reference numeral 47 denotes an end portion for mounting thereto a handle not illustrated Each of the upper oil chamber S1, intermediate oil chamber S2, and lower oil chamber S3 are oil chambers for containing oil. The accumulator chamber S4 has an upper portion that a gas, whose pressure is higher than the atmospheric pressure, and having a lower portion that the operating oil, is contained in. The accumulator chamber S4 is communicated with the lower oil chamber S3 by way of a lower oil passage 48 provided at a lower portion of the outer cylinder 21. Also, a reference symbol FS represents an oil surface of the accumulator chamber S4.

In a case where the hollow piston rod 25 has advanced into the inner cylinder 22, the operating oil corresponding to the in going volume of the hollow piston rod 25 is moved from the upper and the lower oil chamber S1, S3 into the accumulator chamber S4. Therefore, the oil level FS rises. On the other hand, in a case where the hollow piston rod 25 has retreated from the inner cylinder 22, the operating oil corresponding to the outgoing volume of the hollow piston rod 25 is moved from within the accumulator chamber S4 into the upper and the lower oil chamber S1, S3. Therefore, the oil level FS falls. In this way, the accumulator chamber S4 compensates for a change in the volume of the operating oil within the upper and lower oil chambers S1 and S3.

As has been explained above, the hollow piston rod 25 is extended from the piston 23 to the outboard motor 15 side. It is thereby possible to prevent the hollow piston rod 25 portion that has protruded from the outer cylinder 21 to the outside from being immersed in the water. In this ways, it is possible to prevent the occurrence of rusting, corrosion, etc. in the hollow piston rod 25, and also to prevent the attachment of shellfish, foreign matter, etc. to it.

Accordingly, it is possible to maintain the function of the tilt cylinder device 20 for a long period of time.

Figure 3B:
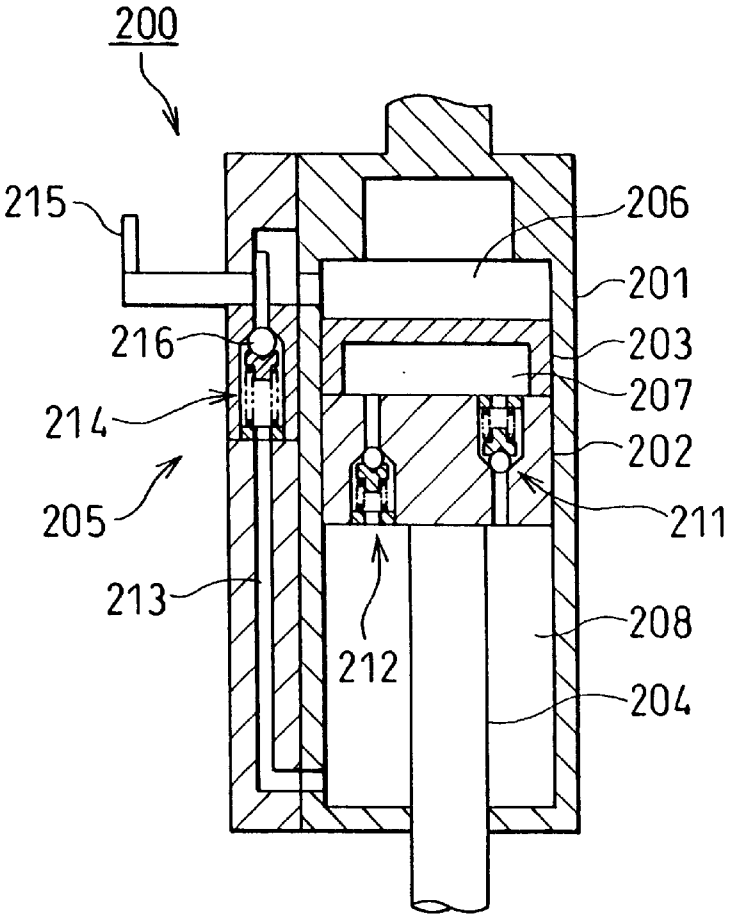
FIGS. 3A and 3B are sectional views illustrating tilt cylinder devices, respectively.
Figure 3A:
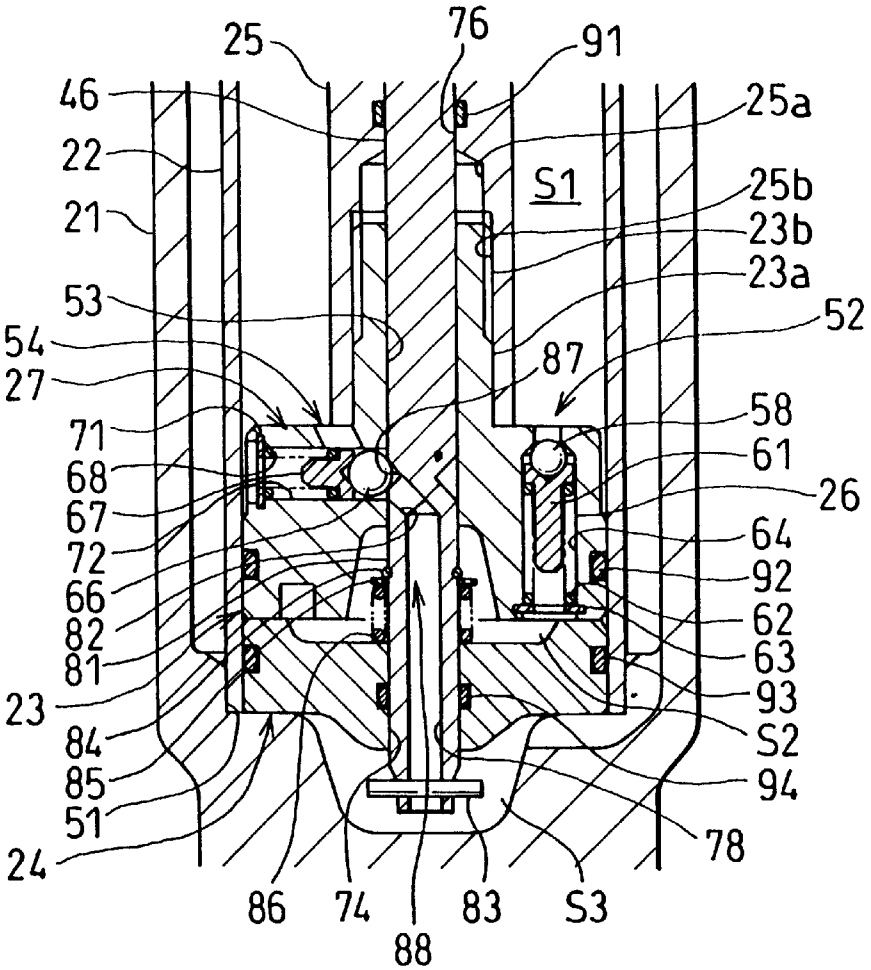

FIGS. 3A and 3B are sectional views illustrating the tilt cylinder devices. FIG. 3A Frustrates this embodiment; and FIG. 3B illustrates a comparative example.

In the embodiment of FIG. 3A, the inner cylinder 22 has a lower end fitted into a lower hole 51 provided in the outer cylinder 21.

The piston 23 includes a first communication passage 52 communicating the upper oil chamber S1 with the intermediate oil chamber S2, a rod-piercing hole 53 for movably inserting the operation rod 46 of the opening/closing mechanism 28 (see FIG. 2) therethrough, and a lateral communication passage 54 communicating the rod-piercing hole 53 and the upper oil chamber S1. The first relief valve 26 is provided at a midway position of the first communication passage 52 while the second relief valve 27 is provided at a midway position of the lateral communication passage 54. It is to be noted that a reference symbol denotes a protruding portion 23*a* that is made to protrude toward above the piston 23; and a reference symbol 23*b* denotes an externally threaded portion formed on the protruding portion 23*a*.

The first relief valve 26 uses the piston 23 concurrently both as a valve case and as a valve seat. It includes a valving element 58, a spring 62 for upwardly urging the valving element 58, i.e., urging the valving element 58 to a "dose" side, via a retainer 61, a supporting plate 63 for supporting a lower portion of the spring 62, and a valve chamber 64 for accommodating the valving element 58, the retainer 61, the spring 62, and the supporting plate 63.

The second relief valve 27 concurrently uses the piston 23 as a valve case, and an opening portion 87, as later described, of the operation rod 46 concurrently serves as a valve seat. The valve 27 includes a valving element 66, a spring 68 for urging the valving element 66 to the operation rod 46 side that is a "dose" side, via a retainer 67, a supporting plate 71 for supporting an end portion of the spring 68, and a valve chamber 72 for accommodating the valving element 66, the retainer 67, the spring 68, and the supporting plate 71.

The free piston 24 is equipped with a rod-piercing hole 74 for movably inserting the operation rod 46 therethrough.

The hollow piston 25 is equipped with a rod-piercing hole 76 that serves as a hollow portion for movably inserting the operation rod 46 therethrough. It is to be noted that a reference symbol 25*a* denotes a lower hole provided in a lower end of the hollow piston rod 25; and a reference symbol 25*b* denotes an internally threaded portion formed in the lower hole 25*a* in order to be screw-engaged with the externally threaded portion 23*b* of the piston 23.

The operation rod 46 is equipped with a vertical hole 78 formed in the lower end portion thereof and an oblique hole 82 opened in an outer-peripheral surface 81 from the vertical hole 78. The operation rod 46 has a lower end portion through which a pin 83 is passed. A ring 84 is mounted on the outer-peripheral surface 81 located above the free piston 24. Between the ring 84 and the upper surface of the free piston 24 are disposed a washer 85 and a spring 86 from above in the order mentioned. By the spring 86, the operation rod 46 is pushed upwardly with respect to the free piston 24.

The oblique hole 82 is constructed with an arrangement wherein an opening portion 87 serving as an inlet thereof on the outer-peripheral 81 side is tapered and this tapered portion is used as a valve seat of the second relief valve 27. The valving element 66 of the second relief valve 27 is pressed against the opening portion 87 to thereby dose the second relief valve 27.

The above-described lateral communication passage 54, the vertical hole 78, and the oblique hole 82 constitute a third communication passage 88.

Here, reference numerals 91 to 94 denote O-rings, respectively.

In the comparative example of FIG. 3B, a tilt cylinder device 200 includes a cylinder 201, a piston 202 and free piston 203 that are movably inserted into the cylinder 201, a piston rod 204 that is downwardly extended from the piston 202, and a valve mechanism 205 that is provided at a side portion of the cylinder 201. The interior of the cylinder 201 is divided into a first chamber 206 located above the free piston 203, a second chamber 207 located between the free piston 203 and the piston 202, and a third chamber 208 located below the piston 202.

The first chamber 206 is filled with a gas and an operating oil while the second chamber 207 and the third chamber 208 are each filled with the operating oil.

The piston 202 is equipped with a first relief valve 211 and a one-way valve 212.

The valve mechanism 205 is equipped with an external communication passage 213 that communicates the first chamber 206 and the third chamber 208 within the cylinder 201. At the midway position of the external communication passage 213 is disposed a second relief valve 214.

The second relief valve 214 is the valve that is opened when the piston rod 204 advances into the cylinder 201 by an external force and the pressure within the first chamber 206 has exceeded a set pressure. Also, the valve 214 is the one that can be manually opened and closed by operating a handle 215 and thereby moving the valving element 216.

In the embodiment of the FHG. 3A illustration, the third communication passage 88 communicating the upper oil chamber S1 and the lower oil chamber S3, and the second relief valve 27, are provided within the outer cylinder 21. Nothing protrudes outside the outer cylinder 21 and therefore it is possible to make the tilt cylinder device 20 compact. Accordingly, even when the space between the stem bracket 12 and the swivel bracket 14 illustrated in FIG. 1 is narrow, the device 20 can be easily installed.

In contrast to this, in the comparative example of FIG. 3B, the external communication passage 213, the second relief valve 214, and the opening/closing mechanism are all provided on the outer-peripheral portion of the cylinder 201. Therefore, for example, when the tilt cylinder device 20 is installed in the space between the stem bracket and the swivel bracket, it is considered as being possible that the external communication passage 213, second relief valve 214, and opening/closing mechanism will protrude, and as a result the device 20 will interfere with those brackets, or other parts. Therefore, it is necessary to make such space large.

Figure 4:
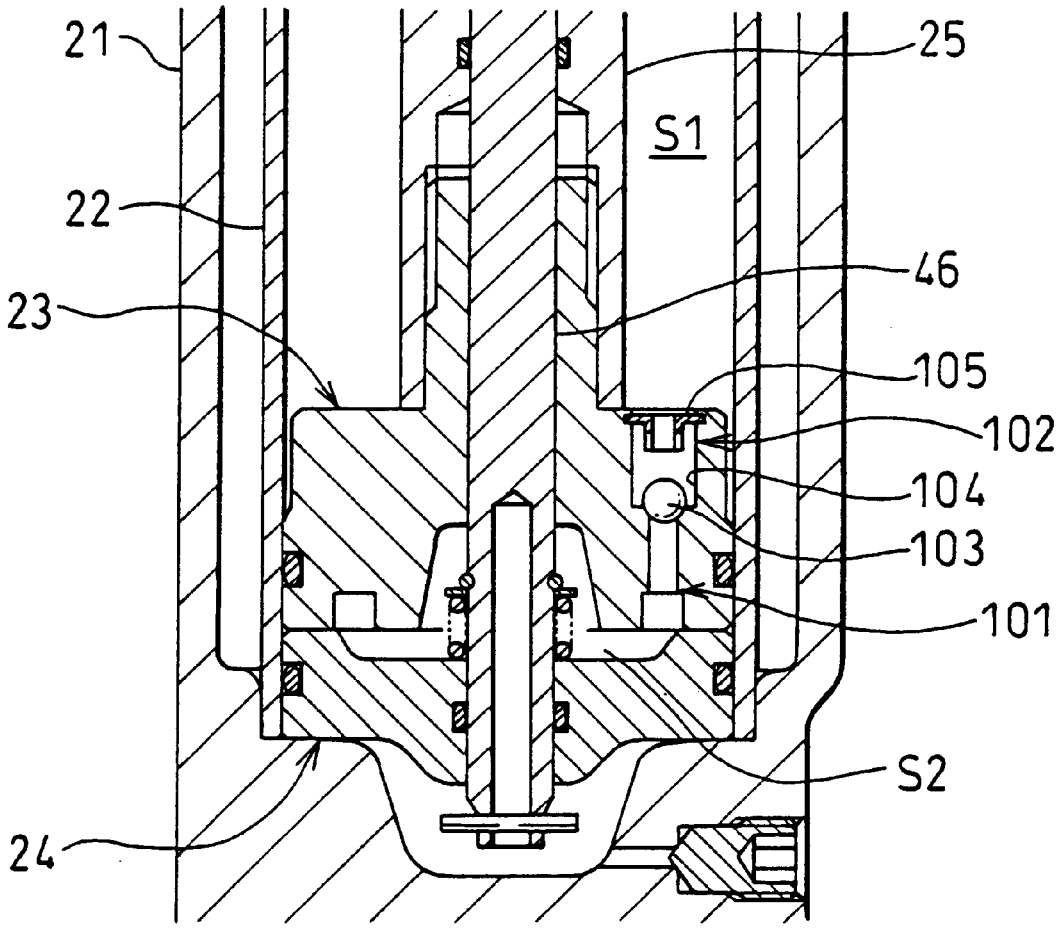
FIG. 4 is a sectional view illustrating a main part of the tilt cylinder device according to the present invention.

FIG. 4 is a sectional view of a main part of the tilt cylinder device according to the present invention. FIG. 4 is another sectional view separate from the one of FIG. 3A.

The piston 23 is equipped with the second communication passage 101 communicating the upper oil chamber S1 and the intermediate oil chamber S2. The piston 23 is the one wherein a one-way valve 102 is interposed at the midway position of the second communication passage 101, the one-way valve 102 permitting the flow of only the operating oil directed from the intermediate oil chamber S2 to the upper oil chamber S1.

The one-way valve 102 uses the piston 23 concurrently both as a valve case and as a valve seat. The valve 102 is equipped with a valving element 103, a valve chamber 104 accommodating therein the valving element 103, and a hole-equipped lid 105 provided on the opening portion of the valve chamber 104.

Next, the function of the manual operation of the above-described tilt cylinder device 20 will be explained.

Figure 5B:
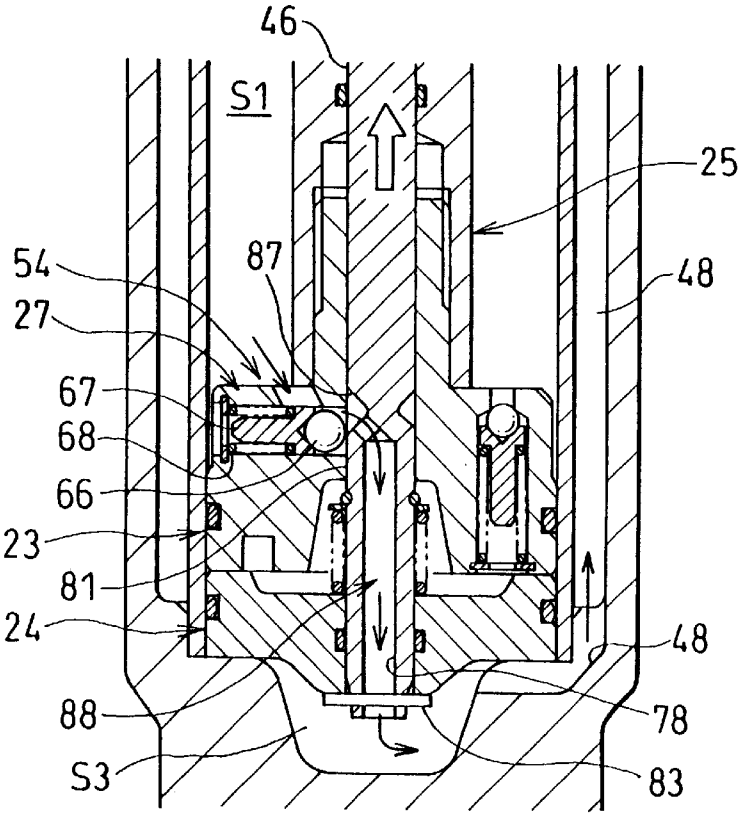
FIGS. 5A and 5B are views illustrating the function of the manual operation of the tilt cylinder device according to the present invention.
Figure 5A:
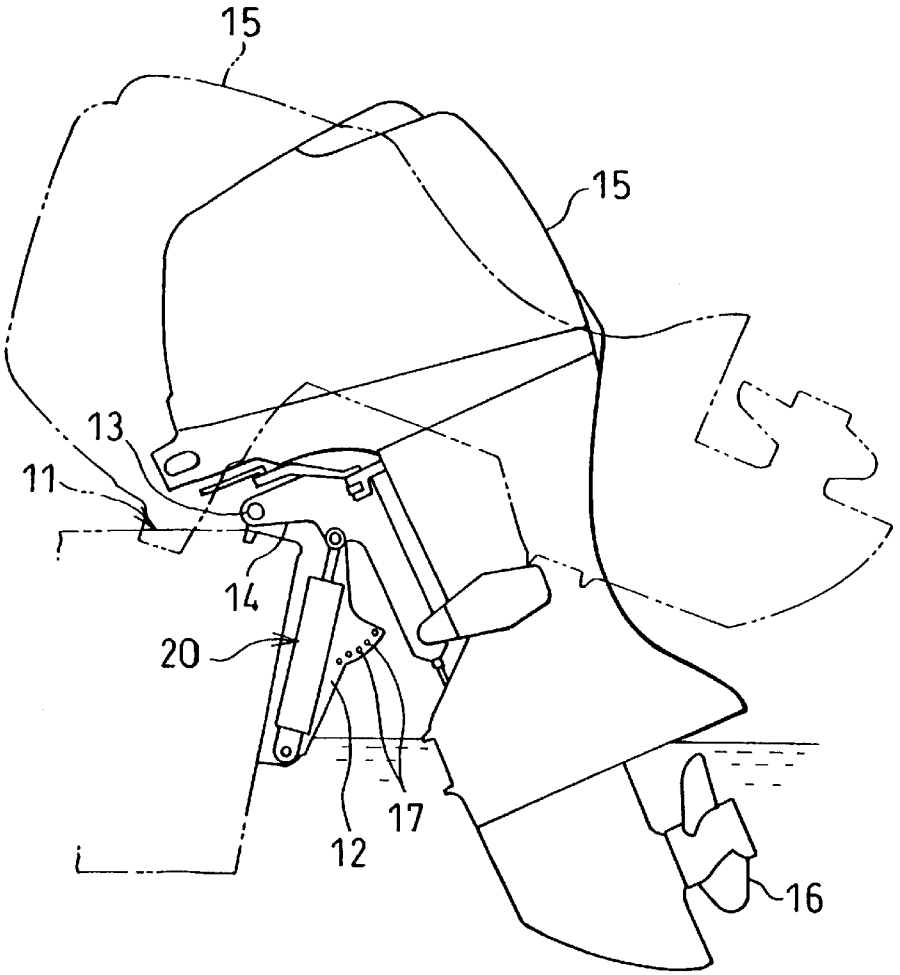

FIGS. 5A and 5B are illustrations explaining the function of the manual operation of the tilt cylinder device according to the present invention. FIG. 5A illustrates a tilted state of the outboard motor 15 while FIG. 5B illustrates a state of operating oil in the tilt cylinder device 20.

In FIG. 5A, for example, when the boat travels on a shallow, it is necessary that the outboard motor 15 be upwardly tilted from the state illustrated in FIG. 1 up to the state of FIG. 5A so that a lower end of the outboard motor 15 does not interfere with the sea bottom or the river bottom.

In such a case, first, in FIG. 1, the shaft 43 of the opening/closing mechanism 28 is rotated by applying a single-purpose handle not illustrated onto the end portion 47.

By doing so, the cam portion 44 is rotated to thereby raise the operation rod 46, which an elastic force has been upwardly imparted to, by the spring 86 (see FIG. 3A).

In FIG. 5B, by raising the operation rod 46, the opening portion 87 of the operation rod 46 is moved to the upper side. As a result of this, the valving element 66 of the second relief valve 27 is moved away from the opening portion 87 that is the valve seat. The second relief valve 27 is opened with the result that the upper oil chamber S1 and the lower oil chamber S3 are communicated with each other via the third communication passage 88. The operating oil then becomes able to flow between the oil chambers S1 and S3. As a result, the vertical movement of the piston 23, free piston 24, and hollow piston rod 25 becomes possible.

Next, in FIG. 5A, while the state of FIG. 5B is kept as is, the outboard motor 15 is manually upwardly tilted through a desired degrees angle.

At this time, since a pulling force acts on the tilt cylinder device 20, the piston 23, free piston 24 and hollow piston rod 25 illustrated in FIG. 5B start to rise. As a result, the pressure within the upper oil chamber S1 increases, whereby the operating oil within the upper oil chamber S1 flows into the lower oil chamber S3 via the third communication passage 88 as indicated by the arrows.

At this time, the pressure of the gas within the accumulator chamber S4 helps the expansion of the tilt cylinder device 20 (see FIG. 5A). Therefore, the operator can easily perform the above-described upward tilting operation.

Thereafter, when rotating the cam shaft 43 of the opening/closing mechanism 28 illustrated in FIG. 2, the cam portion 44 is rotated whereby the operation rod 46 of FIG. 5B is lowered.

As a result of this, the valving element 66 of the second relief valve 27 goes into the opening portion 87 of the operation rod 46 and is thereby seated therein. Therefore, the second relief valve 27 is closed, whereby the state illustrated in FIG. 3A is again reached.

Accordingly, the flow of operating oil is prevented between the upper oil chamber S1 and the lower oil chamber S3. Therefore, the piston 23 becomes unable to be moved up and down, whereby the outboard motor is brought to a tilt-locked state.

As a result of this, the boat becomes able to travel along a shallow. Also, when landing the hull onto the coast, similarly, the outboard motor 15 can be tilted nearly up to a horizontal level with the manual operation of the tilt cylinder device 20 illustrated in FIG. 5A This state of tilt can be maintained.

When it is wanted to bring the outboard motor 15 back to an almost orthogonal state again, it is only necessary to open the second relief valve 27 (see FIG. 5B) with the above-described manual operation.

As a result of this, the outboard motor 15 is slowly brought back to an almost orthogonal state by its own weight. It is to be noted that at this time the operating oil within the inner cylinder 22 (see FIG. 5B) flows along a path reverse to that along which the operating oil flows when the outboard motor 15 has been upwardly tilted.

Next, the function of the tilt cylinder device 20 in a case where a change is made from travel along a shallow to ordinary travel will be explained.

Figure 6B:
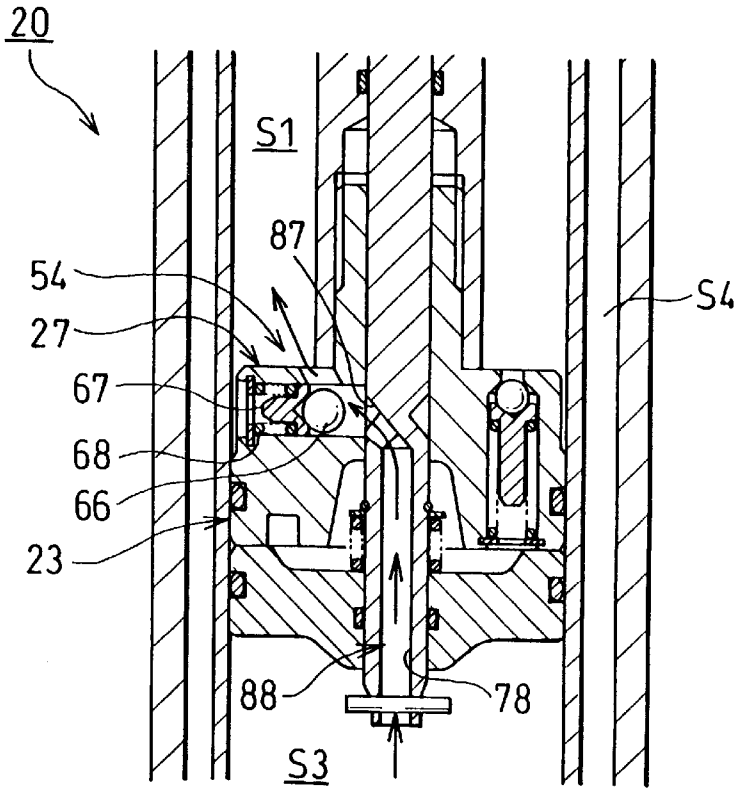
FIGS. 6A and 6B are views illustrating the function of the tilt cylinder device according to the present invention in a case where a change is made from shallow travel to ordinary travel.
Figure 6A:
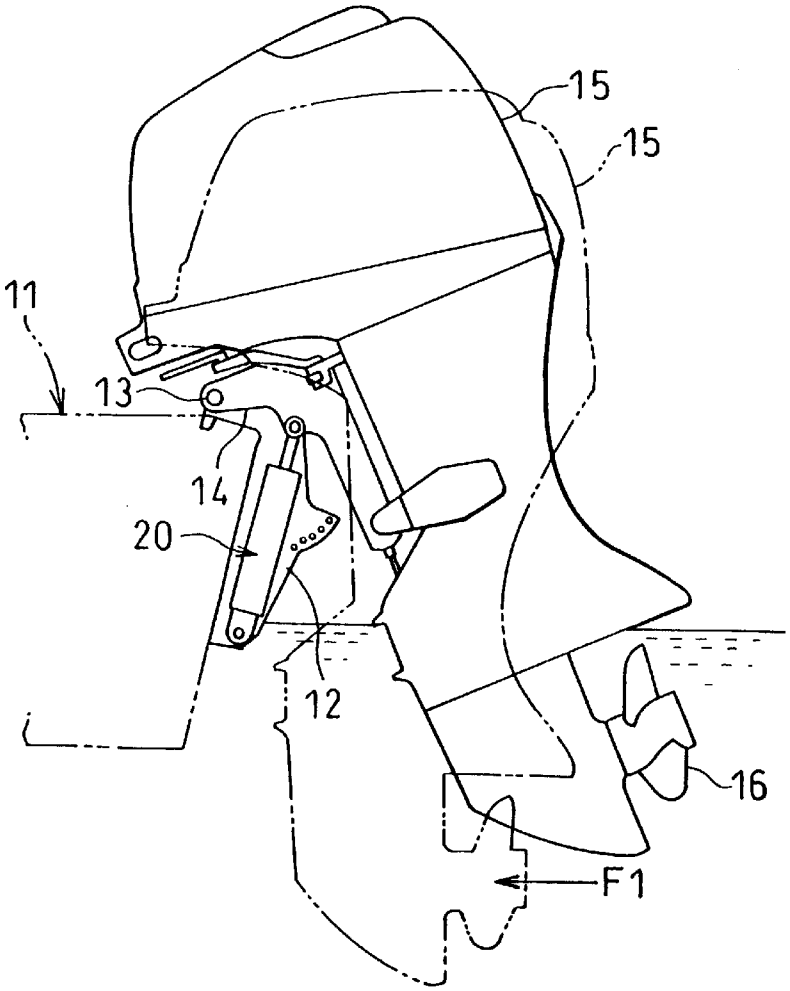

FIGS. 6A and 6B are function illustrations each for explaining the function of the tilt cylinder device according to the present invention in the case where a change is made from travel along a shallow to ordinary travel.

For example, there is a case where, after having made a shallow travel with the outboard motor 15 being kept in a tilted state near the coast, illustrated in FIG. 6A, the boat goes out into the open sea and a change is made to ordinary travel with the outboard motor 15 being kept in a nearly vertically directed state illustrated in FIG. 1.

At this time, an increase is caused of the output of the outboard motor 15 while the same is being kept in a state of FIG. 6A As a result of this, due to the increased propulsion force of the outboard motor 15, a force F1 in the forward direction of the hull acts on a lower portion of the tilted outboard motor 15.

Therefore, a compression force acts on the tilt cylinder device 20.

Due to the compression force of the tilt cylinder device 20, in FIG. 6B, the pressure within the lower oil chamber S3 is increased And when the difference between this pressure and the pressure within the upper oil chamber S1 has exceeded a prescribed value, the second relief valve 27 is opened. As a result, the operating oil within the lower oil chamber S3 flows into the upper oil chamber S1 via the third communication passage 88. The piston 23 is thereby lowered, and the outboard motor 15 illustrated in FIG. 6A is brought to a nearly vertically directed state illustrated in FIG. 1.

Next, it is now assumed that the outboard motor 15 be in such a tilted state as illustrated in FIG. 6A and that in this state during a reverse travel on a shallow, driftwood, etc. collides with the outboard motor 15. Under this assumption, when the force F1 in the forward direction of the hull has acted on a lower portion of the outboard motor 15, also, similarly to the above, the second relief valve 27 (see FIG. 6B) is opened. Mitigation is made of the impact to thereby enable preventing the impairment of the outboard motor 15.

As has been explained above in connection with FIG. 3A, the opening/closing mechanism 28 (see FIG. 2) is constructed as follows. The operation rod 46 is freely movably inserted into the rod piercing hole 76 provided within the piston rod 25. The vertical hole 78 and the oblique hole 82, constituting a part of the third communication passage 88, are formed within the operation rod 46. The second relief valve 27 is disposed in the opening portion 87 constituting a part of the third communication passage 88. With this arrangement, the second relief valve 27 is opened or dosed by moving the operation rod 46 within the hollow piston rod 25. Therefore, the second relief valve 27 can concurrently serve also as the valve that is to be opened or closed from the outside by the opening/closing mechanism 28. It is therefore possible to reduce the number of parts used, make the tilt cylinder device 20 (see FIG. 2) small in size, and lower the manufacturing cost.

Also, it is possible to reduce the number of parts used as compared to the case where the operation rod 46 for opening or closing the second relief valve 27 and the third communication passage 88 causing communication between the upper and the lower oil chamber S1, S3 are provided separately from each other. It is thereby possible to obtain the same effects as those mentioned above.

Next, the function of absorbing an impact when a pulling force has been applied to the tilt cylinder device 20 during a forward travel will be explained.

Figure 7:
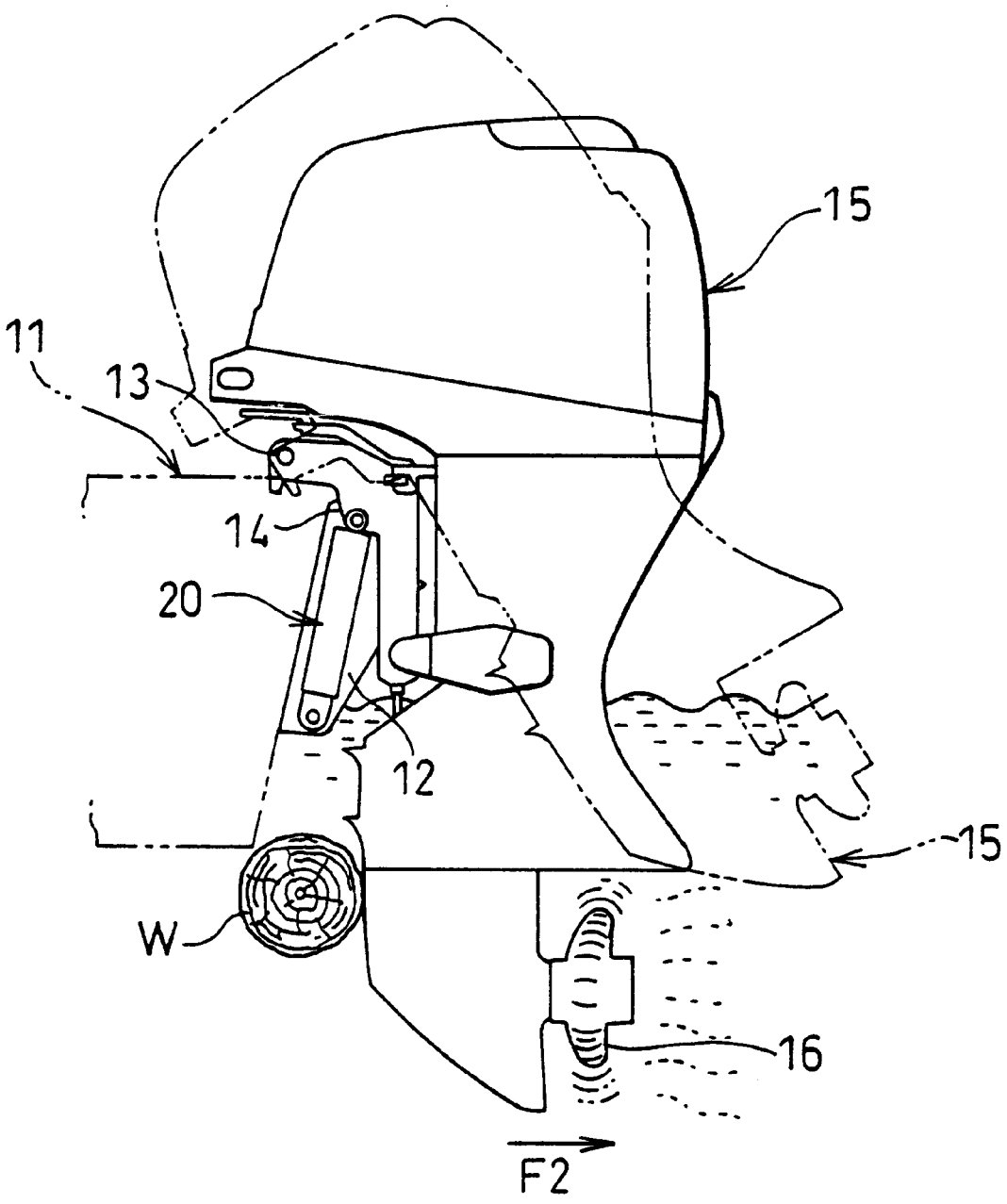
FIG. 7 is a view (the first half) illustrating the impact absorbing function of the tilt cylinder device according to the present invention.

FIG. 7 illustrates the first half of the impact-absorbing function of the tilt cylinder device according to the present invention. This figure illustrates a state where an external force has acted on the outboard motor.

Figure 8B:
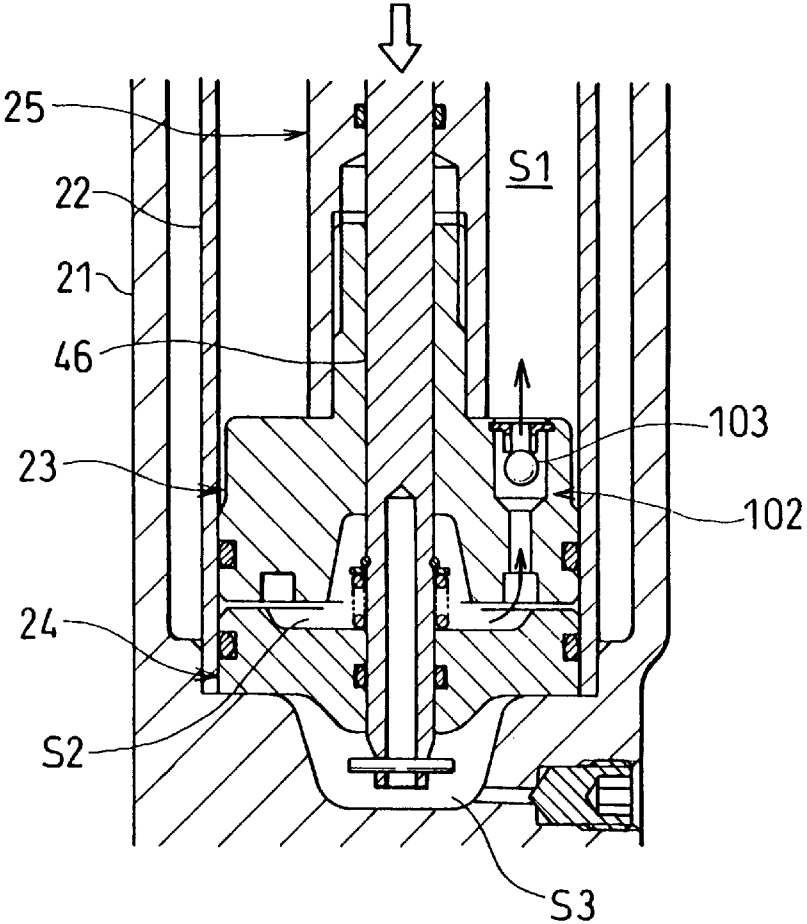
FIGS. 8A and 8B are views (the second half) illustrating the impact absorbing function of the tilt cylinder device according to the present invention.
Figure 8A:
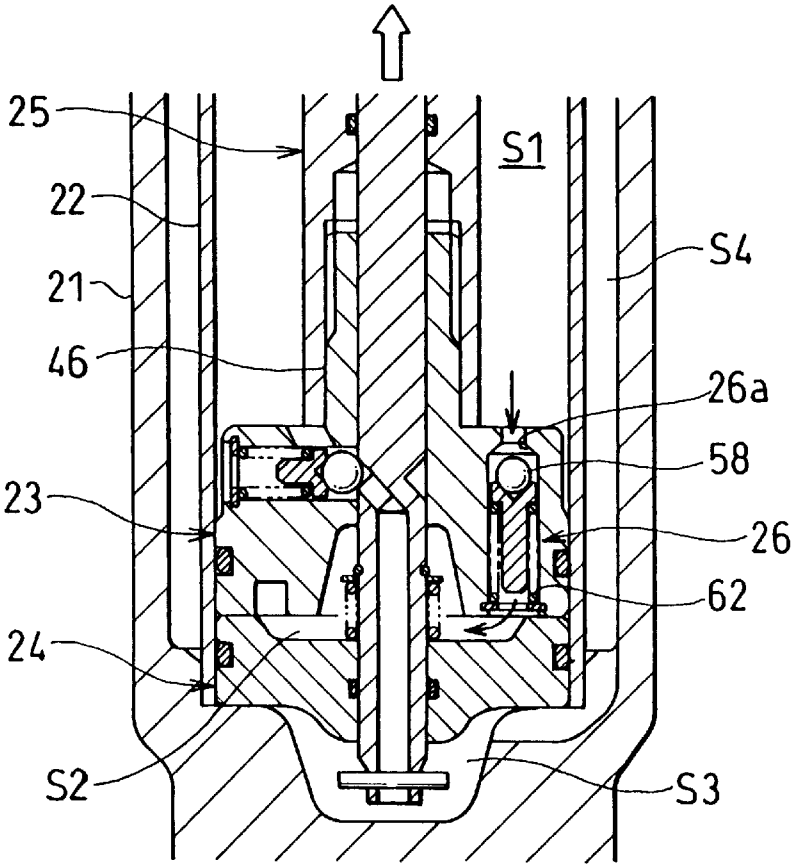

FIGS. 8A and 8B illustrates the second half of the impact-absorbing function of the tilt cylinder device according to the present invention. FIG. 8A illustrates a state where the first relief valve 26 is opened while FIG. 8B illustrates a state where the one-way valve 102 is opened.

In FIG. 7, for example, it is now assumed that during ordinary travel, driftwood W has collided with a front part of the outboard motor 15 that is kept in a nearly vertically directed state shown by a solid line. In such a case, a backward force F2 such as that indicated by the arrow acts on the lower portion of the outboard motor 15, and as a result a pulling force acts on the tilt cylinder device 20.

Due to this pulling force acting on the tilt cylinder device 20, in FIG. 8A, the piston 23 and the hollow piston rod 25 tend to rise with respect to the inner cylinder 22. As a result, the pressure within the upper oil chamber S1 increases.

When the pressure within the upper oil chamber S1 has exceeded a set pressure, i.e., the set pressure=(the set load upon the spring 62 of the first relief valve 26)÷(the sectional area of the portion of contact of the valving element 58 with the valve seat 26*a*), the first relief valve 26 is opened.

When the first relief valve 26 is opened, the piston 23 starts to rise with respect to the inner cylinder 22. The operating oil within the upper oil chamber S1 flows into the intermediate oil chamber S2 as indicated by the arrow. As a result, the tilt cylinder device 20 illustrated in FIG. 7 is expanded, whereby the outboard motor 15 is tilted up to the position indicated by an imaginary line.

As a result of this, the tilt cylinder device 20 absorbs the impact acting upon the outboard motor 15, thereby preventing the impairment of the outboard motor 15.

In FIG. 8A, when the piston 23 has risen, the free piston 24 rises through the inner cylinder 22 by the extent to which compensation is made for the operating oil corresponding to the outgoing volume of the hollow piston rod 25 going out of the interior of the inner cylinder 22.

In FIG. 7, when the external force ceases to act on the outboard motor 15, in FIG. 8B, the piston 23 stops rising and the pressure within the upper oil chamber S1 decreases down to a level lower than the set pressure. As a result, the first relief valve 26 (see FIG. 8A) is closed.

Thereafter, due to the weight of the outboard motor 15 (see FIG. 7) and the propulsion force, a compression force acts on the tilt cylinder device 20 (see FIG. 7). Therefore, the piston 23 tends to fall within the inner cylinder 22, with the result that the pressure within the intermediate chamber S2 increases.

As a result of this, the one-way valve 102 is opened and the operating oil within the intermediate oil chamber S2 flows into the upper oil chamber S1. Simultaneously, the piston 23 is lowered within the inner cylinder 22 up to the position of free piston 24.

At this time, the free piston 24 is lowered by the extent to which compensation is made for the operating il corresponding to the in going volume of the hollow piston rod 25 into the inner cylinder 22.

Accordingly, in FIG. 7, the tilt cylinder device 20 is reduced, whereby the outboard motor 15 is brought to an almost vertically directed state indicated in the solid line from the tilted state.

With the above-described construction, the present invention brings about the following effects.

The tilt cylinder device for an outboard motor of the present invention is constructed as follows. The upper il chamber above the piston and the lower oil chamber below the free piston are provided within the cylinder. The third communication passage communicates the upper oil chamber and the lower oil chamber with each other in such a way as to cover from the piston to the free piston. The second relief valve that opens when the pressure within the lower oil chamber has exceeded the set pressure is provided in the third communication passage. Therefore, compared to the conventional technique wherein the third communication passage, second relief valve, and manually operable opening/closing mechanism are provided outside the cylinder, no protrusion exists. As a result, it is possible to make the tilt cylinder device compact.

Also, since the piston rod has been extended from the piston to the outboard motor side, it is possible to prevent the piston rod from being immersed in the water. Therefore it is also possible to eliminate the inconvenience of shellfish, etc. attaching onto the piston rod.

Furthermore, the tilt cylinder device for an outboard motor of the present invention has the pressure-accumulating chamber formed by enclosing the cylinder with the outer cylinder. There is no protruding portion of the tilt cylinder device. Therefore, it is possible to make the tilt cylinder device small in size. In addition, by forming the accumulator chamber with the use of the outer cylinder, it is possible to lessen the increase in the outside diameter of the accumulator chamber and at the same time to increase the capacity of the accumulator chamber.

Furthermore, the tilt cylinder device for an outboard motor of the present invention has its opening/closing mechanism arranged wherein the operation rod is freely movably inserted into each of the piston rod and the piston. The operation rod is passed through the intermediate oil chamber and is inserted into the through hole formed in the free piston. A forward end of the operation rod is made to face the lower oil chamber. A part of the third communication passage is formed from this forward end up to a midway position of the operation rod. The second relief valve is disposed at an inlet on an operation-rod midway position side of the part of the third communication passage, whereby the operation rod is moved within the piston rod, piston, and free piston to thereby open or dose the second relief valve. The second relief valve can concurrently serve also as the valve that is to be opened or closed from the outside by the opening/closing mechanism. It is therefore possible to reduce the number of parts used, make the tilt cylinder device small in size, and suppress the manufacturing cost.

Also, it is possible to reduce the number of parts used compared to the case where the operation rod for opening or closing the second relief valve and the third communication passage causing the communication between the upper and the lower oil chamber are provided separately from each other. It is thereby possible to obtain the same effects as those mentioned above.

As heretofore explained, embodiments of the present invention have been described in detail with reference to the drawings. However, the specific configurations of the present invention are not limited to the embodiments but those having a modification of the design within the range of the present invention are also included in the present invention.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A tilt cylinder device for an outboard motor comprising: a piston, a piston rod extended to an outboard motor side and a free piston located below the piston which are movably inserted into a cylinder; an upper oil chamber defined by the piston and the free piston and located above the piston, an intermediate oil chamber between the piston and the free piston, and a lower oil chamber located below the free piston provided within the cylinder, an accumulator chamber provided for compensating for the volume of an operating oil through the intermediary of only the lower oil chamber to follow inward and outward movement of the piston rod, the accumulator chamber arranged and constructed as a volume compensation chamber provided in such a way as to surround the cylinder, a first and a second communication passage communicating the upper oil chamber with the intermediate chamber provided in the piston, a first relief valve arranged and constructed such that when the pressure within the upper oil chamber has exceeded a set pressure, the relief valve is automatically opened to absorb the impact, the relief valve being disposed in the first communication passage, a one-way valve permitting the flow of operating oil from the intermediate oil chamber into the upper oil chamber being disposed in the second communication passage, a third communication passage communicating the upper oil chamber and the lower oil chamber, and a second relief valve arranged and constructed such that when the pressure within the lower oil chamber has exceeded a set pressure, the second relief valve is opened to the third communication passage, and an opening/closing mechanism for opening or closing the second relief valve from the outside is provided to the second relief valve, whereby in a state of travel on a shallow where the piston and the free piston are moved toward the upper oil chamber and the outboard motor has thereby been swung up to a midway position from a use position to a standby position, when the pressure within the lower oil chamber has exceeded the set pressure, the piston and the free piston are automatically moved toward the lower oil chamber through the opening of the second relief valve, and the outboard motor is thereby moved from the shallow travel position to the use position to thereby enable releasing the state of shallow travel.

2. A tilt cylinder device for an outboard motor according to claim 1, wherein the accumulator chamber is formed in such a way as to surround the cylinder by an outer cylinder.

3. A tilt cylinder device for an outboard motor according to claim 1, wherein the opening/closing mechanism is arranged to include an operation rod freely movably inserted into each of hollow portions that have respectively been provided within the piston rod and the piston, the operation rod passes through the intermediate oil chamber and is freely movably inserted into a through hole formed in the free piston, a forward end of the operation rod faces the lower oil chamber, a part of the third communication passage is formed from this forward end up to a midway position of the operation rod, and the second relief valve is disposed at an inlet on an operation-rod midway position side of the part of the third communication passage, whereby the operation rod is moved within the piston rod, piston, and free piston to thereby open or close the second relief valve.

4. A tilt cylinder device for an outboard motor according to claim 2, wherein the opening/losing mechanism is arranged to include an operation rod freely movably inserted into each of hollow portions that have respectively been provided within the piston rod and the piston, the operation rod passes through the intermediate oil chamber and is freely movably inserted into a through hole formed in the free piston, a forward end of the operation rod faces the lower oil chamber, a part of the third communication passage is formed from this forward end up to a midway position of the operation rod, and the second relief valve is disposed at an inlet on an operation-rod midway position side of the part of the third communication passage, whereby the operation rod is moved within the piston rod, piston, and free piston to thereby open or close the second relief valve.

* * * * *